United States Patent [19]

Pote et al.

[11] Patent Number: 4,758,685

[45] Date of Patent: Jul. 19, 1988

[54] FLEXIBLE COAXIAL CABLE AND METHOD OF MAKING SAME

[75] Inventors: William Pote, Glenn Gardner; Robert Landsman, Chester, both of N.J.

[73] Assignee: Flexco Microwave, Inc., Port Murray, N.J.

[21] Appl. No.: 933,986

[22] Filed: Nov. 24, 1986

[51] Int. Cl.[4] ..... H01B 11/18; H01B 13/22

[52] U.S. Cl. ..... 174/29; 29/828; 156/55; 156/56; 174/28; 333/243

[58] Field of Search ..... 174/28, 29; 29/828; 156/53, 55, 56, 86; 333/243

[56] References Cited

U.S. PATENT DOCUMENTS

| | | | |
|---|---|---|---|
| 2,348,641 | 5/1944 | Parker | 174/102 D |
| 2,436,284 | 2/1948 | Bondon | 174/28 |
| 2,890,263 | 6/1959 | Brandes et al. | 174/102 D |
| 2,995,616 | 8/1961 | Nicolas | 174/120 R |
| 3,002,047 | 9/1961 | Mannella | 174/102 D |
| 3,173,990 | 3/1965 | LaMons | 174/28 |
| 3,564,108 | 2/1971 | Schmitz | 174/28 |
| 3,582,536 | 6/1971 | Miller | 174/102 D |
| 3,797,104 | 3/1974 | Pote | 29/593 |
| 4,346,253 | 8/1982 | Saito et al. | 174/29 |

FOREIGN PATENT DOCUMENTS

| | | | |
|---|---|---|---|
| 752006 | 9/1933 | France | 174/29 |
| 616303 | 1/1949 | United Kingdom | 174/28 |

*Primary Examiner*—Morris H. Nimmo

*Attorney, Agent, or Firm*—Stiefel, Gross & Kurland

[57] ABSTRACT

An improved flexible coaxial cable (24) and method of making same employs an inner conductor (22) having a helically wound dielectric beading (20) wound thereabout in a predetermined pitch dependent on the desired velocity of propogation for the cable (24). A heat shrinkable dielectric tubing (26) surrounds the helically wound beading (20) and locks it to the inner conductor (22) to provide a dielectric core (28) having a constant pitch for the helically wound beading (20) during flexing of the cable (24). A convoluted outer conductor (30, 32, 34, 36) is locked to the tubing (26) of the dielectric core (28) by crimping it to the dielectric core (28) between the helically wound convolutions of the outer conductor (30, 32, 34, 36).

15 Claims, 3 Drawing Sheets

FLEXIBLE COAXIAL CABLE AND METHOD OF MAKING SAME

CROSS-REFERENCE TO RELATED APPLICATIONS

This application is related to my prior U.S. Pat. No. 3,797,104, entitled "Flexible Coaxial Cable and Method of Making Same" and is an improvement thereon.

TECHNICAL FIELD

The present invention relates to improvements in flexible coaxial cables and the methods of making such a cable.

BACKGROUND ART

Coaxial cables, such as for microwave transmission, have existed in the prior art for a considerable period of time. As technology has developed, a need for flexible coaxial cables whose electrical characteristics do not vary during flexure of the cable, such as in aerospace utilizations, has developed. In such utilizations, often the electrical characteristics of the cable are critical and any variation therein will yield unsatisfactory transmissions via such cables. In order to increase the flexibility of prior art coaxial cables, corrugated outer conductors, such as disclosed in U.S. Pat. Nos. 3,582,536; 3,173,990 and 2,890,263 have been utilized. In addition, other prior art attempts of providing such flexibility a corrugated outer sheath for the cable rather than a corrugated outer conductor, such as disclosed in U.S. Pat. No. 3,002,047. Furthermore, this concept of a corrugated outer sheath has been utilized for standard electrical cables, as opposed to coaxial cables, where such cables are exposed to considerable flexure, such as disclosed in U.S. Pat. Nos. 2,348,641 and 2,995,616.

In order to ensure electrical stability for a coaxial cable, the relative location between the various portions of the outer conductor, the dielectric and the inner conductor must remain constant during flexure of the cable or the electrical characteristics may vary. Prior art attempts to ensure this stability have involved the locking of a corrugated outer conductor to the dielectric surrounding the inner conductor, such as disclosed in U.S. Pat. No. 3,173,990 wherein such inner conductor is a foam polyethylene. However, such prior art flexible coaxial cables do not have sufficient flexibility nor do they have sufficient temperature stability, which also affects the electrical characteristics. These prior art coaxial cables utilize either a tube which is crimped to provide a corrugated tube or form the outer conductor by means of helically winding a piece of conductive material, welding the adjacent pieces together to then form a tube and thereafter crimping alternate longitudinal portions so as to provide a corrugated tube. In both instances, the maximum pitch for the convolutions of the outer conductor is severely limited. In the first instance, this limitation is primarily due to rupture of the conductive tube if the crimps are too closely spaced together whereas, in the second instance, the limitations are primarily due to the inability to sufficiently control the thickness of the resultant tube which is formed as a thin enough material cannot be utilized to produce a high pitch. Since the higher the pitch of the convoluted outer conductor, the greater the flexibility of the coaxial cable, these prior art flexible coaxial cables have not been satisfactory where large degrees of flexure are required together with electrical and temperature stability over a wide range of flexure.

Furthermore, these prior art flexible coaxial cable have primarily been of the foam polyethylene or solid dielectric type whereas flexible coaxial cables utilizing spline dielectrics have not exhibited satisfactory electrical and temperature stability characteristics.

These disadvantages of the prior art have been overcome to an extent by my prior invention of U.S. Pat. No. 3,797,104 employing a solid dielectric. However, the ability to provide flexible coaxial cables for certain applications in which a particular velocity of propagation or lower attentuation was required was somewhat limited as was the ability to readily change the velocity of propagation of the flexible coaxial cable to the desired value during manufacture. Moreover, although there have been prior art attempts to use helically wound dielectrics for coaxial cable, they have not been satisfactorily employed for flexible coaxial cable, particularly since any change in pitch of the helically wound dielectric during flexing of the cable wound undesirably change the properties of the cable. These disadvantages of the prior art are overcome by the present invention.

DISCLOSURE OF INVENTION

An improved flexible coaxial cable and method of making same employs an inner conductor having a helically wound dielectric beading wound thereabout in a predetermined pitch dependent on the desired velocity of propagation for the coaxial cable, with a heat shrinkable dielectric tube surrounding the helically wound dielectric beading and heat shrinkably locking it to the inner conductor to provide a dielectric core having a constant pitch for the helically wound beading during flexing of the cable. A convoluted outer conductor formed a corrugated tube locked to the dielectric core heat shrinkable dielectric tubing, such by crimping it to the dielectric core between the helically wound convolutions of the outer conductor. The helically wound dielectric beading and the heat shrinkable dielectric tubing may be formed of any desired dielectric material, such as TFE, FEP or polyolefin. The improved flexible coaxial cable, when bent or flexed, will have stability in such parameters as voltage standing wave ratio, attenuation, phase, delay and impedance.

BEST MODE FOR CARRYING OUT THE INVENTION

Figure 5:
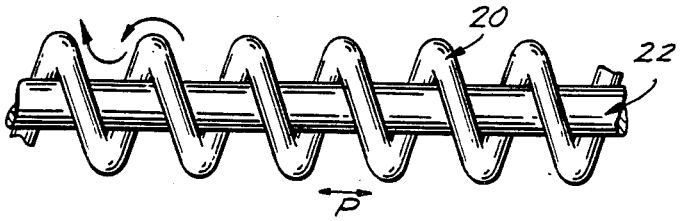
FIGS. 5–10 are diagrammatic illustrations of various steps in practicing the presently preferred improved method of the present invention.

Referring now to the drawings in detail, and intially to FIGS. 5–10 thereof, the presently preferred improved method of the present invention shall be described which method is an improvement on the method disclosed in U.S. Pat. No. 3,797,104, the contents of which are specifically incorporated by reference herein in their entirety. As shown and preferred, in practicing the presently preferred improved method of the present invention, a bead of the desired dielectric material 20, such a TFE, FEP or a polyolefin, is tightly helically wound around the inner conductor of a flexible coaxial cable to be formed, such as a silver plated inner or center conductor 22, as illustrated in FIG. 5. The dielectric bead 20 is helically wound to a desired pitch "p" which pitch together with the dielectric properties of the material determine the velocity of propagation and delay of the resultant flexible coaxial cable 24. A wider pitch "p" allows more air in the resultant coaxial cable 24 dielectric, thereby decreasing the amount of dielectric material, the dielectric constant, and dielectric losses. This also changes the velocity of propagation and the delay of the resultant coaxial cable 24. The reverse is true if the pitch "p" is made narrower. A lower dielectric constant resulting from a wider pitch "p" would decrease the number of degrees in a specific electrical length of coaxial cable 24. With the outer conductor size remaining the same, a larger inner or center conductor 22 would be required in order to retain the same impedance. The resultant larger center or inner conductor 22 would lower the attenuation of the resultant coaxial cable 24 due to its increased circular mils, which is a function of losses.

Figure 1:
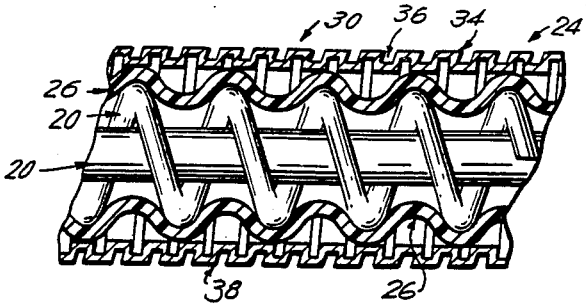
FIG. 1 is a cross sectional view of a presently preferred embodiment of an improved flexible coaxial cable produced in accordance with the improved preferred method of the present invention.
Figure 2:
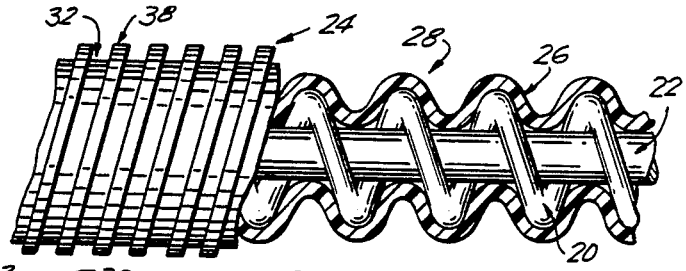
FIG. 2 is cutaway view partially in section of the improved flexible coaxial cable of FIG. 1.
Figure 3:
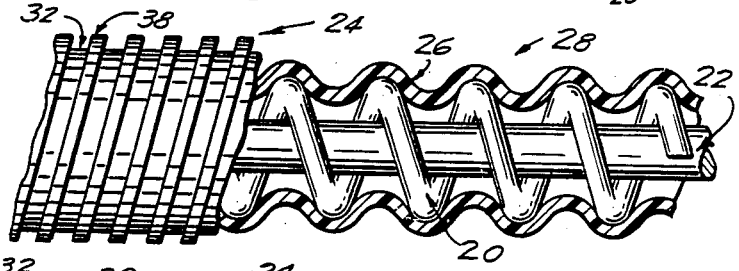
FIG. 3 is a cutaway view, partially in section, similar to FIG. 2, of an alternative embodiment for the improved flexible coaxial cable of FIGS. 1 and 2.
Figure 4:
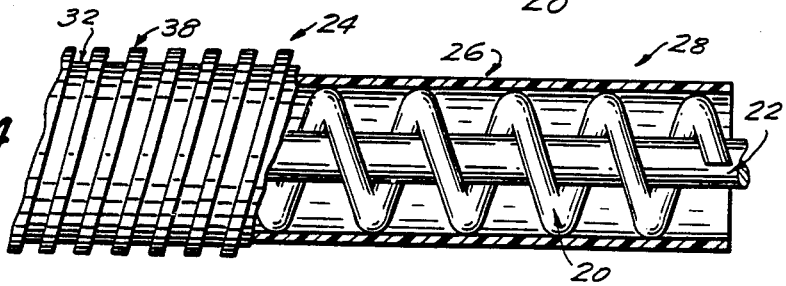
FIG. 4 is a cutaway view, partially in section, similar to FIG. 2, of still another alternative embodiment for the improved flexible coaxial cable of FIGS. 1 and 2.
Figure 6:
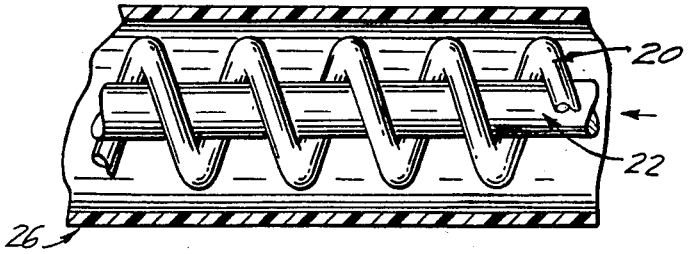
Figure 7:
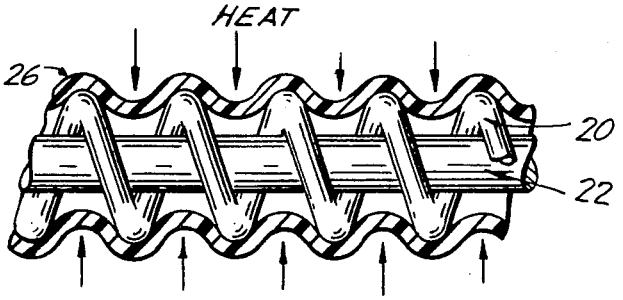
Figure 9:
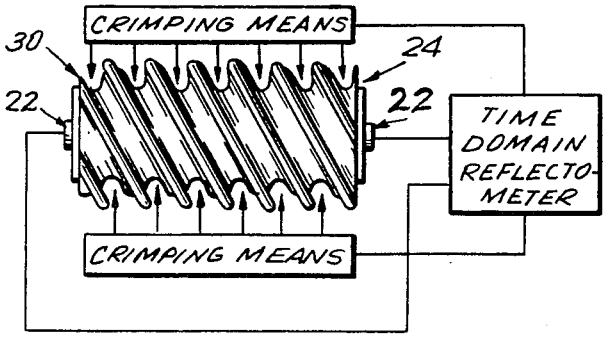
Figure 10:
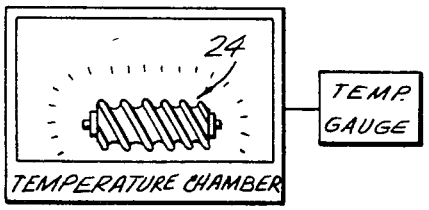

In order to obtain stability for the resultant cable 24 while flexing or bending, the tightly wound helical beading 20 is inserted in a heat shrinkable dielectric tube 26, such as one preferably formed of the same dielectric material as the beading 20, and whose inside diameter is slightly larger than the peak-to-peak outer diameter of the helically wound beading 20, as illustrated in FIG. 6. The heat shrinkable dielectric tubing is then heated to a temperature sufficient to cause the tube 26 to shrink sufficiently to lock the tightly wound helically wound beading 20 to the inner conductor 22 as illustrated in FIG. 7. The amount of shrinking which occurs depends on the desired configuration for the resultant dielectric core 28 formed by the heat shrunk tubing 26 and the helically wound bead 20. FIGS. 2–4 illustrate different configurations for the resultant dielectric core 28, with FIGS. 1 and 2 illustrating a presently preferred configuration. The amount of shrinking conventionally depends on the temperature and the heating time.

Figure 8:
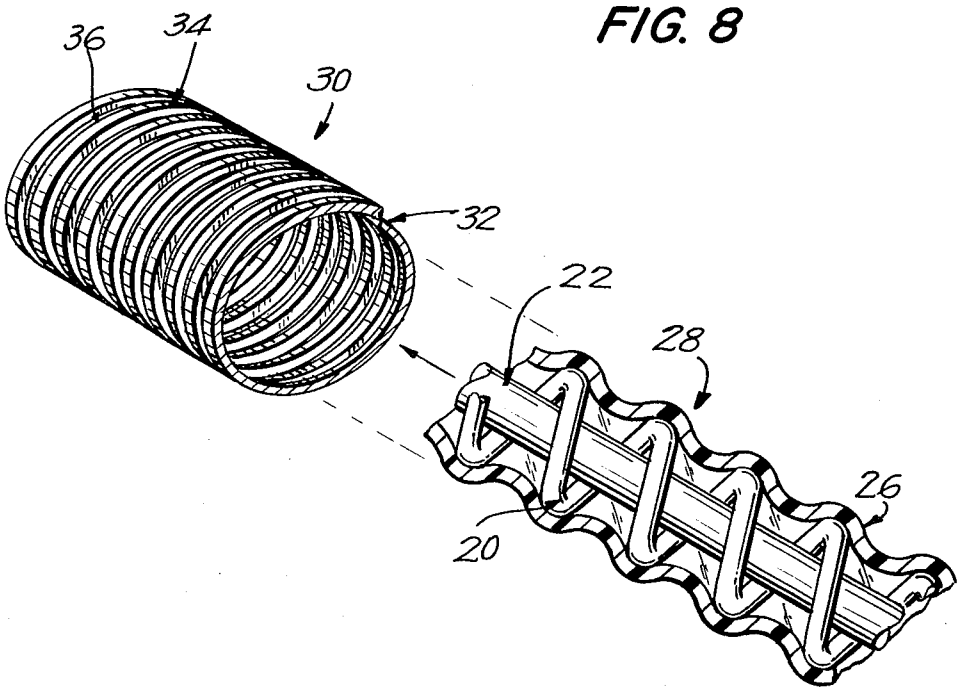

As illustrated in FIG. 8 the resultant dielectric core 28 and inner conductor 22 are then inserted in a convoluted outer conductor 30, such as one preferably composed of a corrugated main conductive member 32 which has been corrugated to produce peaks 34 and valleys 36 in the conductive member 30 at a predetermined pitch, such as the outer conductive member described in my U.S. Pat. No. 3,797,104. As with that outer conductor, a helically wound conductive strip 38 preferably composed of the same conductive material as the main conductive member 32, is preferably helically wound about the main conductive member 32 so as to have the strip wound conductor 38 be helically wound about the peaks 34 of the corrugated main conductive member 32. The conductive strip 38 is preferably secured to these peaks 34, such as by soldering, so as to form a single unitary composite conductive member, such as disclosed in U.S. Pat. No. 3,797,104, wherein the peaks 34 are accentuated by the helically wound strip 38 so as to increase the flexibility of the outer conductor 30. The outer conductor 30 is then, preferably mechanically crimped to the dielectric core 28 in the manner described in my prior U.S. Pat. No. 3,797,104, with the coupling being to the tubing 26, in accordance with the desired characteristic impedance of the resultant cable 24, such as by using a conventional time domain reflectometer 40, with the crimping points preferably being in the valleys 36 of the outer conductor 30. The crimped locked cable 24 may then preferably be temperature cycled in a conventional temperature chamber 42 to provide temperature stability for the cable 24 as also disclosed in my prior U.S. Pat. No. 3,797,104, with FIGS. 9 and 10 being illustrations of the crimping and temperature cycling processes described in my prior U.S. Pat. No. 3,797,104.

Referring now to FIGS. 2–4, various alternative arrangements for the resultant flexible cable 24 made in accordance with the above described method of the present invention is shown. The primary difference between each of the three embodiments shown in FIGS. 2–4, with the embodiment of FIG. 2 being illustrated in greater detail in FIG. 1, resides in the amount of shrinkage of dielectric tubing 26. The embodiment of FIGS. 1 and 2 preferably has the dielectric tubing 26 substantially conform to the contours of the helically wound dielectric bead 20, whereas the embodiment of FIG. 3 conforms substantially less to these contours, while the embodiment of FIG. 4 is substantially linear in configuration, merely being shrunk sufficiently to contact the helically wound dielectric bead 20 in locking relation. With respect to these embodiments, the greatest locking of the tubing 26 to the bead 20 would occur with the embodiment of FIG. 2 while the easiest crimping of the outer conductor 30 to the tubing 26 would occur with the embodiment of FIG. 3.

By utilizing the improved method and resultant flexible cable of the present invention, flexible coaxial cables in which the velocity of propagation may be readily changed during manufacture can be readily provided.

What is claimed is:

1. In a flexible coaxial cable having an inner conductor to which a dielectric material is secured and a convoluted outer conductor formed as a corrugated tube having a plurality of crests disposed theralong and being locked to said dielectric material; the improvement comprising a helically wound dielectric beading wound about said inner conductor, said helically wound dielectric beading having a predetermined pitch setting, the velocity of propagation associated with said coaxial cable being determined by said pitch setting and said dielectric material; and a heat shrinkable dielectric tubing surrounding said helically wound dieletric beading and shrinkably locking said helically wound beading to said inner conductor for providing a dielectric core having a constant pitch for said helically wound beading during flexing of said coaxial cable, said outer conductor being locked to said heat shrinkable dielectric tubing.

2. An improved flexible coaxial cable in accordance with claim 1 wherein said helically wound dielectric beading is comprised of TFE.

3. An improved flexible coaxial cable in accordance with claim 2 wherein said heat shrinkable dielectric tubing is comprised of TFE.

4. An improved flexible coaxial cable in accordance with claim 1 wherein said heat shrinkable dielectric tubing is comprised of TFE.

5. An improved flexible coaxial cable in accordance with claim 1 wherein said helically wound dielectric beading is comprised of FEP.

6. An improved flexible coaxial cable in accordance with claim 5 wherein said heat shrinkable dielectric tubing is comprised of FEP.

7. An improved flexible coaxial cable in accordance with claim 1 wherein said heat shrinkable dielectric tubing is comprised of FEP.

8. An improved flexible coaxial cable in accordance with claim 1 wherein said helically wound dielectric beading is comprised of polyolefin.

9. An improved flexible coaxial cable in accordance with claim 8 wherein said heat shrinkable dielectric tubing is comprised of polyolefin.

10. An improved flexible coaxial cable in accordance with claim 1 wherein said heat shrinkable dielectric tubing is comprised of polyolefin.

11. An improved flexible coaxial cable in accordance with claim 1 wherein said outer conductor is crimped to said dielectric core between said helically wound convolutions for providing said locked outer conductor.

12. A improved flexible coaxial cable in accordance with claim 1 wherein said helically wound dielectric beading is tightly wound about said inner conductor.

13. An improved method for making a flexible coaxial cable having an inner conductor to which a dielectric material is secured and a convoluted outer conductor formed as a corrugated tube having a plurality of crests disposed theralong and being locked to said dielectric material; the improvement comprising the steps of helically winding a dielectric beading about said inner conductor for providing a desired predetermined pitch for said helically wound dielectric beading for providing a desired predetermined velocity of propagation for said coaxial cable; inserting said inner conductor inside a heat shrinkable dielectric tubing; heat shrinking said dielectric tubing sufficiently to lock said helically wound dielectric beading to said inner conductor for providing a constant pitch for said helically wound dielectric beading during flexing of said coaxial cable, said heat shrunk dielectric tubing and said locked helically wound dielectric beading comprising a dielectric core surrounding said inner conductor; inserting said heat shrunk dielectric core inside said convoluted outer conductor; and locking said convoluted outer conductor to said dielectric core.

14. An improved method in accordance with claim 13 wherein said convoluted outer conductor locking step comprises the step of crimping said outer conductor to said dielectric core between said helically wound convolutions of said outer conductor.

15. An improved method in accordance with claim 14 wherein said step of helically winding said dielectric beading about said inner conductor comprises the step of tightly winding said dielectric beading about said inner conductor.

* * * * *